United States Patent [19]

Jacobs

[11] 4,111,476

[45] Sep. 5, 1978

[54] LATCH HANDLE AND CONTAINER LOCK

[76] Inventor: Stanley A. Jacobs, 45 Kohary Dr., New Haven, Conn. 06515

[21] Appl. No.: 806,602

[22] Filed: Jun. 15, 1977

[51] Int. Cl.[2] ..... B65D 45/16; E05C 19/10

[52] U.S. Cl. ..... 292/246; 220/326; 292/DIG. 38; 292/DIG. 49

[58] Field of Search ..... 16/142, 145, 180; 220/318, 323, 324, 326; 292/DIG. 38, DIG. 49, 257, 259, 247, 246, 250, 103, 107, 248, 249, 114

[56] References Cited

U.S. PATENT DOCUMENTS

| | | | |
|---|---|---|---|
| 460,437 | 9/1891 | Grove | 292/246 |
| 1,042,511 | 10/1912 | Watrous | 292/247 |
| 1,055,073 | 3/1913 | Pearl et al. | 220/318 |
| 1,466,606 | 8/1923 | Trageser | 220/326 |
| 1,469,196 | 9/1923 | Strange | 292/246 |
| 1,481,223 | 1/1924 | Gorman et al. | 292/247 |
| 2,552,641 | 5/1951 | Morrison | 220/324 |
| 2,559,681 | 7/1951 | Senseman | 292/250 |
| 3,134,617 | 5/1964 | Slonneger | 292/DIG. 38 |
| 3,490,805 | 1/1970 | DiPierro et al. | 292/DIG. 49 |
| 4,035,009 | 7/1977 | Jacobs | 292/246 |

*Primary Examiner*—William Price
*Assistant Examiner*—Allan N. Shoap
*Attorney, Agent, or Firm*—Wolf, Greenfield & Sacks

[57] ABSTRACT

An improved latching arrangement is provided for a rigid container having a lid including latching arms pivotally disposed at opposite sides of the container for engaging loops which depend from the periphery of the lid. Each of the latching arms is pivotally mounted to the container sidewall and has a flexible end that interferes, by a bending action, with the container sidewall providing a snap action which retains the latch arm in either a locked or unlocked position. In an alternate embodiment the latch arms are pivotally supported from the loops of the lid, and each have a pivot bar that engages securing hooks extending from the sidewall of the container.

9 Claims, 6 Drawing Figures

LATCH HANDLE AND CONTAINER LOCK

BACKGROUND AND SUMMARY OF THE INVENTION

The present invention relates in general to wide-mouth containers and lockable lids for use therewith such as might be employed in trash cans, paint cans or other similar wide-mouthed containers. The invention is primarily directed to an improved latching arrangement for use in connection with rigid containers which may be constructed from a hard plastic or metal material.

My U.S. Pat. No. 4,035,009, issued July 12, 1977 shows a container and locking lid arrangement for use with a container having a flexible sidewall. One object of the present invention is to provide an improved latching arrangement for a wide-mouth container and lid wherein the container is of relatively rigid construction.

Another object of the present invention is to provide an improved latching arrangement for a wide-mouth container and lid wherein the latch includes a flexible element for use with either rigid or flexible sidewall containers.

To simplify the basic container construction, it is an object of an alternate embodiment of this invention to provide a container and lid arrangement wherein the latching arms pivot from the loops of the lid requiring preferably only engaging means on the container itself.

Another object of the present invention in accordance with an alternate embodiment is to provide latching arms that are removably secured to the loops of the lid.

To accomplish the foregoing and other objects of this invention in accordance with one embodiment thereof, a pair of latching arms are pivotally mounted to diametrically opposite locations on the sidewall of the container below the mouth of the container. The latching arms are for use preferably with a container that is of rigid construction although the principles of this invention are also applicable to containers having flexible or semi-flexible sidewalls. Each of the latching arms is pivotable between a downward extending, locked position and an upwardly extending, open position. The inner end of each latching arm is relatively flexible while the outer end is of more rigid construction. The inner end of each arm projects from its pivot point by a distance which is greater than the distance from the pivot point to the sidewall of the container so that when pivoted between its locked and unlocked positions, the flexible inner end of the latch arm interferes with the sidewall of the container, causing the latch arm inner end to yield or bend enabling the latch arm to snap into its locked or unlocked position depending upon the direction of pivoting. A pair of loops are attached to and hang from diametrically opposite locations on the lid. Fingers are formed on the outer end of the latching arms so that when the latching arms are pivoted to their locked position, they draw the loops downwardly to secure the lid firmly to the container. Each of the latching arms is preferably constructed as a molded plastic handle having a thicker outer end that is relatively rigid and a thinner flexible inner end providing a flexible tongue that is bendable against the sidewall of the container.

In accordance with an alternate embodiment of the invention, the latching arms are preferably snap-fitted to the loops hanging from the lid and are freely rotatable relative to the loops. The arms or handles are secured at their outer end to the loop and have an inner end for contacting the sidewall of the container. A pivot bar or pivot rod is disposed between the ends of the arms for engaging with hooks extending from the sidewall of the container. When the latch arms are pivoted to their locked position, the pivot bar engages with the hooks on the container drawing the loops downwardly as the inner ends of the arms engage the sidewall of the container and finally snap the arms and loops into a locked position securing the lid firmly to the container. In this alternate embodiment, the inner end of the arm may be constructed of a flexible plastic for use with either a rigid or flexible container, or the inner end can be constructed of a rigid material for use only with a flexible container.

BRIEF DESCRIPTION OF THE DRAWINGS

Numerous other objects, features and advantages of the invention should now become apparent upon a reading of the following detailed description taken in conjunction with the accompanying drawings, in which.

DESCRIPTION OF THE PREFERRED EMBODIMENTS

Figure 1:
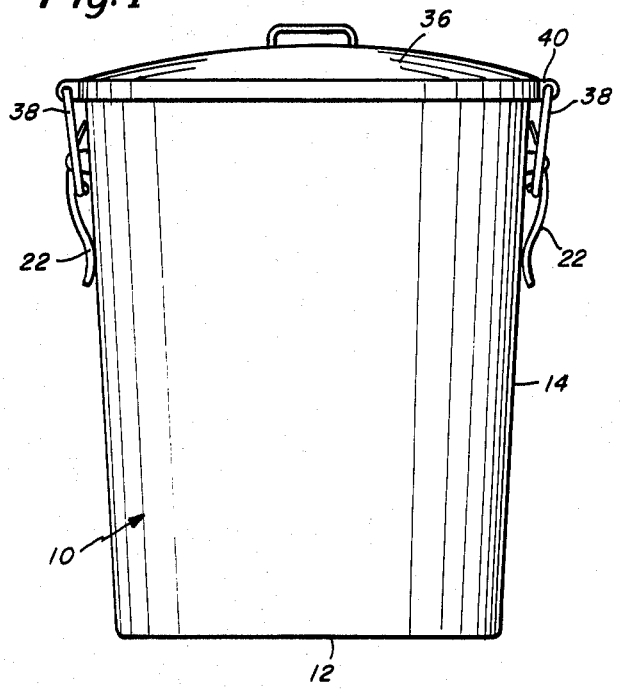
FIG. 1 is a side elevation of a container embodying the invention.

FIGS. 1–4 show an embodiment of the invention as incorporated in a rigid container which may be a metal paint can. The can can be constructed from sheet metal stock or could even be constructed from a rigid plastic material. Further, the flexible latch arm arrangement of this invention could also be used in association with a container having a flexible or semi-flexible sidewall.

The can 10 includes a bottom wall 12 and integral sidewall 14 which extends upwardly from the bottom wall 12 and terminates, typically, in a wide-mouthed rim 16. The sidewall 14 carries two pairs of trunnions 18, located at diametrically opposite locations of the sidewall just below the rim 16. The trunnions 18 in each pair are transversely spaced and have transverse holes 20 extending therethrough. The trunnions 18 may be constructed of metal suitably secured to the container sidewall such as with the use of rivets or the like and may be slightly deflectable so as to permit the trunnions to accept the latching arms.

Each pair of trunnions 18 pivotally supports a latch arm 22. The latch arms are preferably each constructed of a molded plastic material and may be molded from either polyethylene or polypropylene plastic. Alternatively, these arms could also be constructed of a flexible metal such as a spring steel. The latch arms 22 include a transversely extending pivot bar 24, the ends of which are received in the holes 20 to provide a pivot axis for each of the latch arms 22. Each of the latch arms 22 has an inner section 26 and an outer section 28 which are preferably integral with each other and also integral with the pivot bar ends 24. In the embodiment shown in FIGS. 1–4, the pivot bar 24 and the sections 26 and 28 of the latch arm 22 may be fabricated from a polyethylene or polypropylene plastic. The outer section 28 preferably is thicker than the inner section 26. Thus, the outer section is more rigid than the inner section, and the inner section preferably is flexible so that it may even bend into a position such as shown in phantom in the schematic diagram of FIG. 4. The outer section 28 is constructed with a reverse curve so that it is easier to grasp to unlock the latch mechanism. The inner section 26 is bowed and projects away from the pivot bar 24 a distance greater than the distance between the pivot bar 24 and the adjacent container side wall 14 in the region 34 between the trunnions 18.

When the latch arm is pivoted between either of its locked or unlocked positions, the inner section 26 will be urged against the region 34 of the container sidewall and the inner section 26. Because the inner section is inherently resilient and flexible, it yields to permit the latch arm 22 to be pivoted to one or the other position. Because of this flexibility and resiliency of the end 26, the latch handle has a "snap action" as it is pivoted from one position to the other. This action between positions will also occur even with a flexible or semi-flexible container. For a flexible container, it may be desirable to slightly extend the length of the inner section 26 so as to assure this snap action between alternate positions. After the latch handle has been pivoted to the locked position, it will be retained by the interfering engagement of the inner section 26 with the container sidewall 14 as shown in solid in FIG. 3

Figure 3:
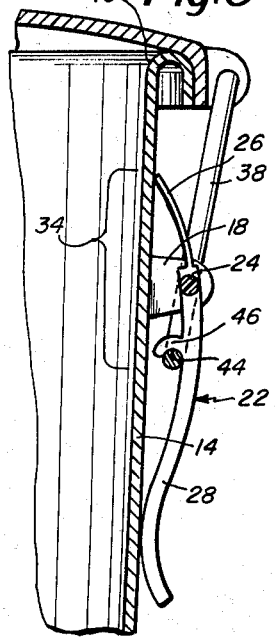
FIG. 3 is a side elevation, in cross-section as taken along line 3—3 of FIG. 2 showing the latch in its locked position.

The container lid 36, which may also be molded from an appropriate plastic material, or may be metal, includes a pair of diametrically opposed locking loops 38 which are pivotally secured to the lid and hang downwardly from diametrically opposite portions of the lid 36. The loops 38 may be secured to the lid by means of trunnions 40 to which the upper ends of the loops 38 may be pivoted. The container lid 36 may be constructed of a plastic material or metal. The loops 38 are located so that each loop will be engageable with one of the latching arms 22. Each loop includes, at its lower region, a transverse bar 42 which is located so that it may be received within an opening 44 formed on the latch arm 22, the opening 44 being defined by one or more fingers 46 secured to the latch arm. The fingers 46 are arranged so that when the latch arm 22 is in its locked position, the opening 44 faces downwardly as depicted in FIG. 3 to retain the transverse bar 42 of locking loop 38. The foregoing various parts of the invention are dimensioned so that when the lid is locked to the container, it will fit on the container rim 16 snugly and will be retained thereon.

Figure 2:
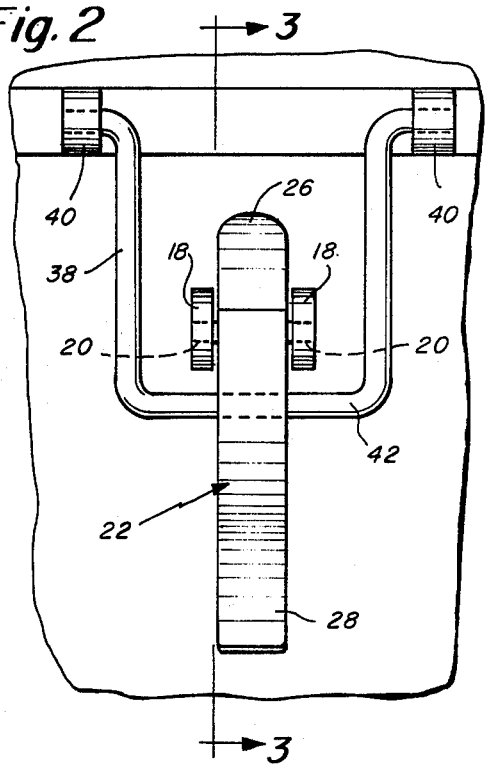
FIG. 2 is an enlarged elevational view of one of the latches for the container as seen from the side of FIG. 1.
Figure 4:
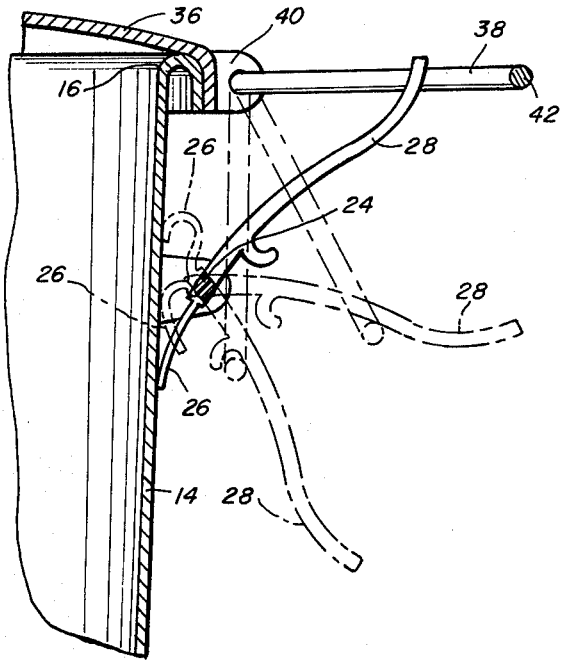
FIG. 4 is a schematic diagram of a view similar to that shown in FIG. 3 showing the latch in its full open position and also in phantom in two other partially closed positions.

FIGS. 2 and 3 show the latch in its locked position. FIG. 4 is a schematic diagram showing in solid the latch in its full open position. FIG. 4 also shows in phantom the latch being half way closed and also being about three-fourths closed. In the three-fourths closed position the inner end 26 is at the end of its bending position and is about to snap into the locked position as indicated in FIGS. 2 and 3.

Figure 5:
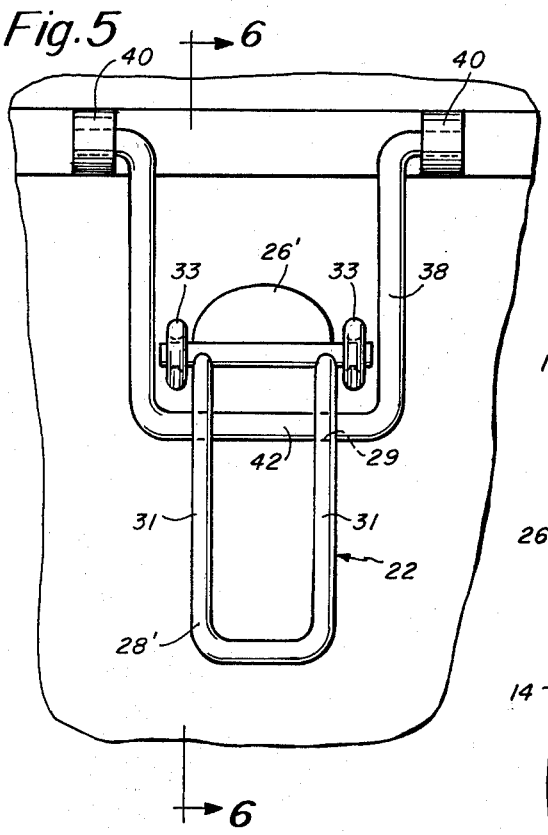
FIG. 5 is an elevation view of the alternate embodiment of the latch.
Figure 6:
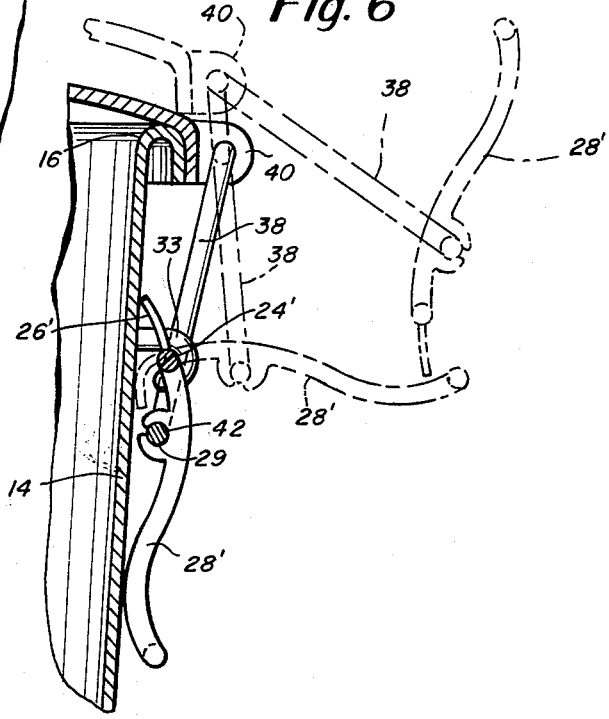
FIG. 6 is a cross-sectional view taken along line 6—6 of FIG. 5 showing the latch in its closed position and also in phantom in partially open positions.

FIGS. 5 and 6 show an alternate embodiment of the invention which simplifies the construction of the container requiring essentially only engaging hooks extending from the sidewall of the container. In the embodiment of FIGS. 5 and 6, the loops 38 may be substantially identical to the loops previously discussed with reference to FIGS. 1–4. These loops are supported by trunnions 40 from the lid 36 and hang downwardly as depicted in FIG. 5. In this embodiment the latch arm 22 is removably secured to the transverse bar 42 of the loop 38 by means of circular cut-outs 29 in the legs 31 of the outer end 28'. With the circular cut-outs the arm 22 snaps onto the transverse bar 42 but is freely rotatable relative to the bar 42.

The latch also has an inner end 26' which is preferably flexible for use with rigid containers, and a pivot rod or pivot bar 24' which is for engaging with a pair of hooks 33 extending from the sidewall 14 of the container. Thus, only the hooks 33 extend from the container sidewall with the latch being supported from the loops extending from the lid.

FIG. 5 shows the latch arrangement in its closed position with the bar 24' engaged by the hooks 33. FIG. 6 shows the latch arrangement in solid in its closed position. FIG. 6 also shows in phantom the latch arm moving from an open position half way toward the closed position with the flexible end 26' being bent against the rigid sidewall of the container. With this embodiment to open the container the latch arm can be pivoted counterclockwise as viewed in FIG. 6 so that the support bar 24' eventually disengages from the hooks 33, permitting the lid to be removed from the container.

With this alternate embodiment of FIGS. 5 and 6 the end 26' may also be made relatively rigid when the latching arrangement is to be used in conjunction with a container having a flexible sidewall.

It should be understood that the foregoing description of the invention is intended merely to be illustrative thereof and that other modifications and embodiments may be apparent to those skilled in the arm without departing from its spirit.

Having thus described the invention, what I desire to claim and secure by Letters Patent is:

1. A latch arrangement for a container and associated lid comprising:

a latch arm having inner and outer ends;

means mounting the said latch arm between its ends, to the exterior of the sidewall of said container below the rim thereof and for pivotal movement between a first and second position about a substantially transverse axis, said axis being spaced outwardly from the sidewall of said container;

said inner end of said latch arm being of resilient, deformable and flexible construction, the distance between said pivotal axis and the closest region of said container sidewall being less than the distance from said pivotal axis to the extremity of said inner end of said latch arm, whereby said latch arm inner end is resiliently deformed when said latch arm is pivoted from one of its positions to the other, a region of said container sidewall being cooperative with the inner end of the latch arm when the latch arm is in either of its positions to retain the latch arm in that position;

a member connected to and extending downwardly from the periphery of the container lid, said member having a transverse portion thereof which, when the lid is on the container, may extend downwardly and be engaged by a portion of said latch arm;

said portion of said latch arm including means for engaging said transverse portion of said member to retain said member and draw said lid member downwardly in response to pivotal movement of said latch arm from one position thereof to the other.

2. A latch as set forth in claim 1 wherein said inner end is thinner in construction than the outer section so as to be more deformable than the outer section.

3. A latch as set forth in claim 1 wherein said latch arm includes a transversely extending pivot bar having transverse ends and trunnions secured to the container sidewall, said trunnions pivotally receiving the transverse ends with the inner end of the latch member being bowed.

4. A latch as set forth in claim 1 further comprising:

the outer end of said latch arm being constructed and arranged so that when said latch arm is in its locked position thereof, at least a portion of said outer end of said latch arm will extend away from the sidewall of said container to facilitate gripping of said latch.

5. A latch as set forth in claim 1 wherein said first and second positions of the latch arm each extend substantially along the sidewall of the container but in opposite directions.

6. A latch arrangement for a container and associated lid as defined in claim 1 further comprising:

said means on the latch arm for enaging said transverse portion of said member being constructed to detachably and pivotally support the latch arm from the transverse portion of the member;

pivot axis means on the latch arm between its ends;

said means mounting the latch arm to the exterior of the sidewall of the container including means extending from the sidewall of the container for detachably receiving the pivot axis means of the latch arm.

7. A latch as set forth in claim 6 wherein said pivot axis means includes a pivot bar disposed between the inner end of the latch arm and the means for pivotally supporting the latch arm.

8. A latch as set forth in claim 7 wherein said means for pivotally supporting the latch arm includes cut-out means for receiving the transverse portion of the member.

9. A latch as set forth in claim 6 wherein said means for receiving the pivot axis means includes hook means.

* * * * *